US006830640B2

(12) United States Patent
Maldonado et al.

(10) Patent No.: US 6,830,640 B2
(45) Date of Patent: Dec. 14, 2004

(54) DUAL CAPILLARY SPINNERET FOR PRODUCTION OF HOMOFILAMENT CRIMP FIBERS

(75) Inventors: Jose Enrique Maldonado, Canton, GA (US); Kurtis Lee Brown, Alpharetta, GA (US); Jeffrey D. Shelley, Cumming, GA (US); Braulio Polanco, Canton, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 194 days.

(21) Appl. No.: 10/238,487

(22) Filed: Sep. 10, 2002

(65) Prior Publication Data

US 2003/0011099 A1 Jan. 16, 2003

Related U.S. Application Data

(63) Continuation of application No. 09/747,278, filed on Dec. 21, 2000, now Pat. No. 6,446,691.

(51) Int. Cl.[7] ..... D01D 5/08; D01D 5/22

(52) U.S. Cl. ..... 156/167; 156/180; 156/181; 264/168; 264/172.14

(58) Field of Search ..... 156/167, 180, 156/181; 425/72.1, 72.2, 461–466; 264/168, 172.14; 186/441, 433

(56) References Cited

U.S. PATENT DOCUMENTS

| | | | |
|---|---|---|---|
| 3,219,739 | A | 11/1965 | Breen et al. |
| 3,249,669 | A | 5/1966 | Jamieson |
| 3,338,992 | A | 8/1967 | Kinney |
| 3,341,394 | A | 9/1967 | Kinney |
| 3,502,538 | A | 3/1970 | Petersen |
| 3,502,763 | A | 3/1970 | Hartmann |
| 3,542,615 | A | 11/1970 | Dobo et al. |
| 3,692,618 | A | 9/1972 | Dorschner et al. |
| 3,802,817 | A | 4/1974 | Matsuki et al. |
| 3,849,241 | A | 11/1974 | Butin et al. |
| 3,920,784 | A | 11/1975 | Nakagawa et al. |
| 3,975,484 | A | 8/1976 | Okada et al. |
| 3,981,948 | A | 9/1976 | Phillips |
| 4,176,150 | A | 11/1979 | Bromley et al. |
| 4,179,259 | A | 12/1979 | Belitsin et al. |
| 4,265,849 | A | 5/1981 | Borenstein |
| 4,340,563 | A | 7/1982 | Appel et al. |
| 4,351,147 | A | 9/1982 | Blackmon et al. |
| 4,383,817 | A | 5/1983 | Mirhej |
| 4,522,773 | A | 6/1985 | Menezes et al. |
| 4,562,029 | A | 12/1985 | Black |
| 4,619,803 | A | 10/1986 | Yu |
| 4,720,314 | A | 1/1988 | Black |
| 4,772,347 | A | 9/1988 | Fowler |
| 4,783,231 | A | 11/1988 | Raley |
| 4,973,236 | A | 11/1990 | Hasegawa et al. |
| 5,407,625 | A | 4/1995 | Travelute et al. |
| 5,609,888 | A | 3/1997 | Uda et al. |
| 5,989,004 | A | 11/1999 | Cook |
| 6,123,886 | A | 9/2000 | Slack |

FOREIGN PATENT DOCUMENTS

| | | |
|---|---|---|
| CA | 1278659 | 1/1991 |
| DE | 1 219 165 | 6/1966 |
| EP | 0 170 645 A2 | 2/1986 |
| EP | 600 331 | 6/1994 |
| EP | 748 272 | 12/1996 |
| FR | 2 044 098 | 2/1971 |
| GB | 936729 | 9/1963 |
| WO | 38358 | 9/1998 |
| WO | 45512 | 10/1998 |

*Primary Examiner*—Sam Chuan Yao
(74) *Attorney, Agent, or Firm*—Pauley Petersen & Erickson

(57) ABSTRACT

Robust homofilament fibers are meltspun from a differently shaped dual capillary spinneret design to induce differential fiber morphology to produce crimping. Crimping may further be aided by quenching and drawing of the fibers.

33 Claims, 3 Drawing Sheets

DUAL CAPILLARY SPINNERET FOR PRODUCTION OF HOMOFILAMENT CRIMP FIBERS

CROSS REFERENCE TO RELATED APPLICATION

This application is a continuation of patent application Ser. No. 09/747,278, filed on 21 Dec. 2000 U.S. Pat. No. 6,446,691.

FIELD OF THE INVENTION

The present invention relates generally to lofty nonwoven fiber webs. The present invention relates specifically to lofty nonwoven fiber webs of homofilament crimped fibers and dual capillary means and method for producing the web.

BACKGROUND OF THE INVENTION

Webs of homofilament crimped thermoplastic fibers are useful for various fluid handling or retaining materials and the like because of their open structure, resiliency, and economy of manufacture. Particularly, the use of a single thermoplastic polymer in the making of the crimped fibers is good for economical and consistent manufacture. However, the present state of the manufacturing art relies largely on bicomponent filaments to induce the desired level of crimping in a consistent fashion leading to certain compromises in the consistency of fabric characteristics and economy thereof.

In the known art several attempts have been made to produce crimping through shaped fibers. Spinnerets having shaped orifices or multiple orifices to produce the shaped fibers are also known. However the known art suffers in several regards. First, the known processing of the shaped fibers is not a robust process in that the fibers are not consistently shaped or the component parts of the fiber do not hold together well, resulting in less predictable web morphology and attendant functional characteristics. Second, the degree of crimping derived from using a single polymer to produce a crimped homofilament has not always attained the desired level.

Therefore, there is a need in the art for a robust and easily accomplished means and method of manufacturing homofilament crimped fiber which has a high degree of crimp and good predictability of the fiber shape and crimping to yield the desired nonwoven web structure.

Definitions

Within the context of this specification, each term or phrase below will include the following meaning or meanings.

"Article" refers to a garment or other end-use article of manufacture, including but not limited to, diapers, training pants, swim wear, catamenial products, medical garments or wraps, and the like.

"Bonded" or "bonding" refers to the joining, adhering, connecting, attaching, or the like, of two elements. Two elements will be considered to be bonded together when they are bonded directly to one another or indirectly to one another, such as when each is directly bonded to intermediate elements.

"Connected" refers to the joining, adhering, bonding, attaching, or the like, of two elements. Two elements will be considered to be connected together when they are connected directly to one another or indirectly to one another, such as when each is directly connected to intermediate elements.

"Disposable" refers to articles which are designed to be discarded after a limited use rather than being laundered or otherwise restored for reuse.

"Disposed," "disposed on," and variations thereof are intended to mean that one element can be integral with another element, or that one element can be a separate structure bonded to or placed with or placed near another element.

"Fabrics" is used to refer to all of the woven, knitted and nonwoven fibrous webs.

"Homofilament" refers to a fiber formed from only one predominate polymer and made from a single stream of that polymer. This is not meant to exclude fibers formed from one polymer to which small amounts of additives have been added for coloration, anti-static properties, lubrication, hydrophilicity, etc.

"Integral" or "Integrally" is used to refer to various portions of a single unitary element rather than separate structures bonded to or placed with or placed near one another.

"Layer" when used in the singular can have the dual meaning of a single element or a plurality of elements.

"Meltblown fiber" means fibers formed by extruding a molten thermoplastic material through a plurality of fine, usually circular, die capillaries as molten threads or filaments into converging high velocity heated gas (e.g., air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed for example, in U.S. Pat. No. 3,849,241 to Butin et al. Meltblown fibers are microfibers which may be continuous or discontinuous, are generally smaller than about 0.6 denier, and are generally self bonding when deposited onto a collecting surface. Meltblown fibers used in the present invention are preferably substantially continuous in length.

"Meltspun" refers generically to a fiber which is formed from a molten polymer by a fiber-forming extrusion process, for example, such as are made by the meltblown and spunbond processes.

"Member" when used in the singular can have the dual meaning of a single element or a plurality of elements.

"Nonwoven" and "nonwoven web" refer to materials and webs of material which are formed without the aid of a textile weaving or knitting process.

"Polymers" include, but are not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to isotactic, syndiotactic and atactic symmetries.

Words of degree, such as "About", "Substantially", and the like are used herein in the sense of "at, or nearly at, when given the manufacturing and material tolerances inherent in the stated circumstances" and are used to prevent the unscrupulous infringer from unfairly taking advantage of the invention disclosure where exact or absolute figures are stated as an aid to understanding the invention.

"Spunbond fiber" refers to small diameter fibers which are formed by extruding molten thermoplastic material as filaments from a plurality of fine capillaries of a spinneret having a circular or other configuration, with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartmann, U.S. Pat. No. 3,502,538 to Petersen, and U.S. Pat. No. 3,542,615 to Dobo et al., each of which is incorporated herein in its entirety by reference. Spunbond fibers are quenched and generally not tacky when they are deposited onto a collecting surface. Spunbond fibers are generally continuous and often have average deniers larger than about 0.3, more particularly, between about 0.6 and 10.

"Surface" includes any layer, film, woven, nonwoven, laminate, composite, or the like, whether pervious or impervious to air, gas, and/or liquids.

"Thermoplastic" describes a material that softens when exposed to heat and which substantially returns to a non-softened condition when cooled to room temperature.

These terms may be defined with additional language in the remaining portions of the specification.

SUMMARY OF THE INVENTION

A homofilament crimped fiber is produced by joining polymer streams exiting through a dual capillary spinneret design. Differently induced shear in the different polymer streams results in differential tensions in the joined halves of the filament. The filaments may further be subjected to differential or directed quenching which provides for setting the crimps in the filaments to further induce the crimp. The filaments may also be desirably drawn out in the spinning processing to achieve a substantially round shape which results in a robust and predictable filament.

The dual capillary design for producing a crimped homofilament fiber according to the present invention has a first capillary and a second capillary spaced apart at a distance sufficiently close to have a single filament formed from concurrent liquid polymer extrusions from the first capillary and the second capillary. The capillaries share a parallel border where they are adjacent each other and are specifically shaped to maximize induced shear. Specific shapes of spinneret orifices and methodologies for using those shapes will be further elaborated on below.

DETAILED DESCRIPTION OF THE PRESENTLY PREFERRED EMBODIMENTS

The present invention provides a method of producing homofilament helical crimped nonwoven web. The present invention is usable with meltspun polymers known to those skilled in the art and most surprisingly works well with polypropylene polymers. In general, the means and method of the present invention comprise using dual shaped capillaries for inducing differential shear between polymer flowing in a first shaped capillary and the polymer flowing in a second differently shaped capillary. The method may further include differential or directed quenching of the filaments. The method may also include drawing the fibers to a round cross sectional shape while still in their plastic state.

In a preferred embodiment of the present invention, the fibers may be formed of resin which is preferably a thermoplastic polypropylene polymer. Other polymers such as, but not limited to, polyolefins, polyesters, polyamides, polyurethanes, copolymers and mixtures thereof might also be used in accordance with certain aspects of the present invention.

Figure 1:
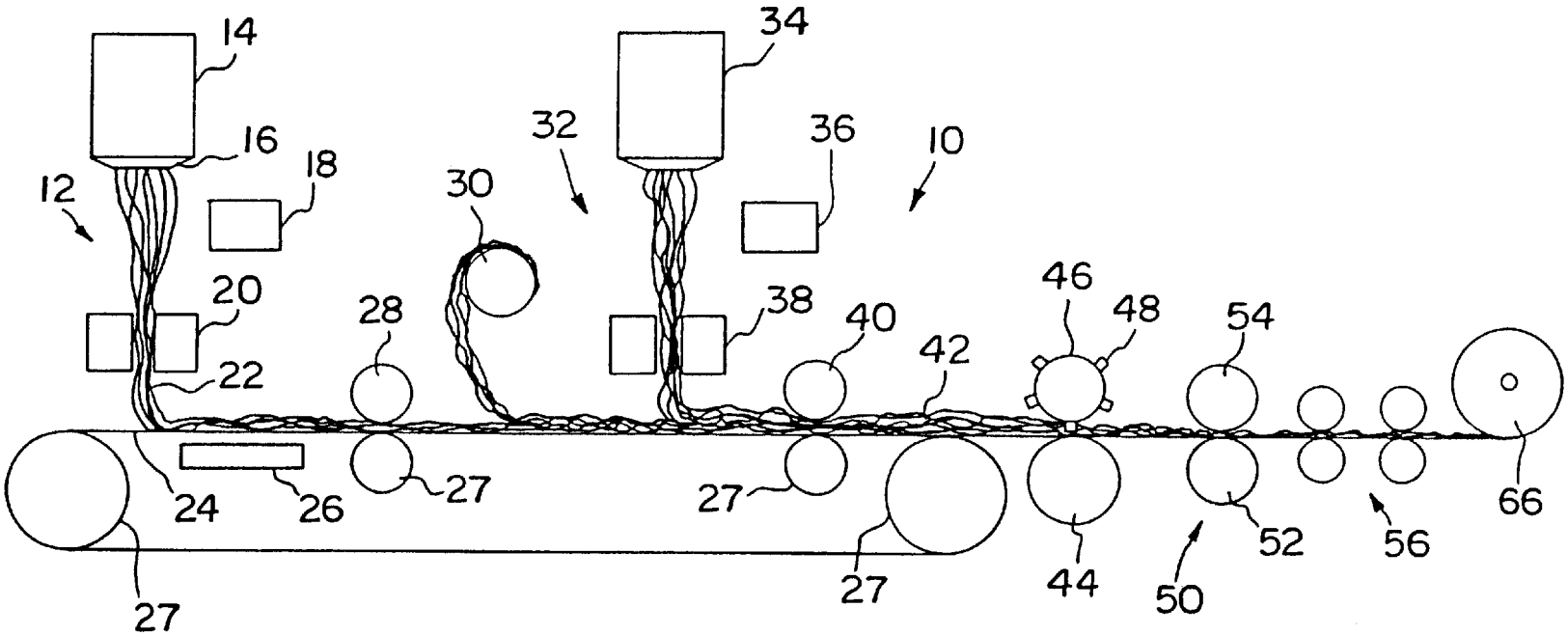
FIG. 1 PRIOR ART
FIG. 1 shows a known apparatus of the general environment used for manufacturing filaments according to the present invention.

FIG. 1 shows an apparatus of the general environment used for manufacturing filaments, or "fibers" as used synonymously therewith, according to the present invention. Apparatus 10 has a first assembly 12 for producing spunbond fibers in accordance with known methods. A spinneret 14 is supplied with molten polymer resin from a resin source (not shown). The spinneret 14 produces fine denier fibers from the exit 16, which are quenched by an air stream supplied by a quench blower 18. The air stream differentially cools one side of the fiber stream more than the other side, thus causing bending and crimping of the fibers. Crimping, as discussed in general hereinabove, creates a softer fabric by reducing the "straightness" of the fibers, between bond points created in the thermal bonding step, as well as fiber-to-fiber bonds. Various parameters of the quench blower 18 can be controlled to control the quality and quantity of crimping. Fiber composition and resin selection also determine the crimping characteristics imparted.

The filaments are drawn into a fiber drawing unit or aspirator 20 having a Venturi tube/channel 22, through which the fibers pass. The tube is supplied with temperature controlled air, which attenuates the filaments as they are pulled through the fiber drawing unit 20. The attenuated fibers are then deposited onto a foraminous moving collection belt 24 and retained on the belt 24 by a vacuum force exerted by a vacuum box 26. The belt 24 travels around guide rollers 27. As the fibers move along on the belt 24, a compaction roll 28 above the belt, which operates with one of the guide rollers 27 beneath the belt, compresses the spunbond mat so that the fibers have sufficient integrity to go through the manufacturing process.

Figure 2:
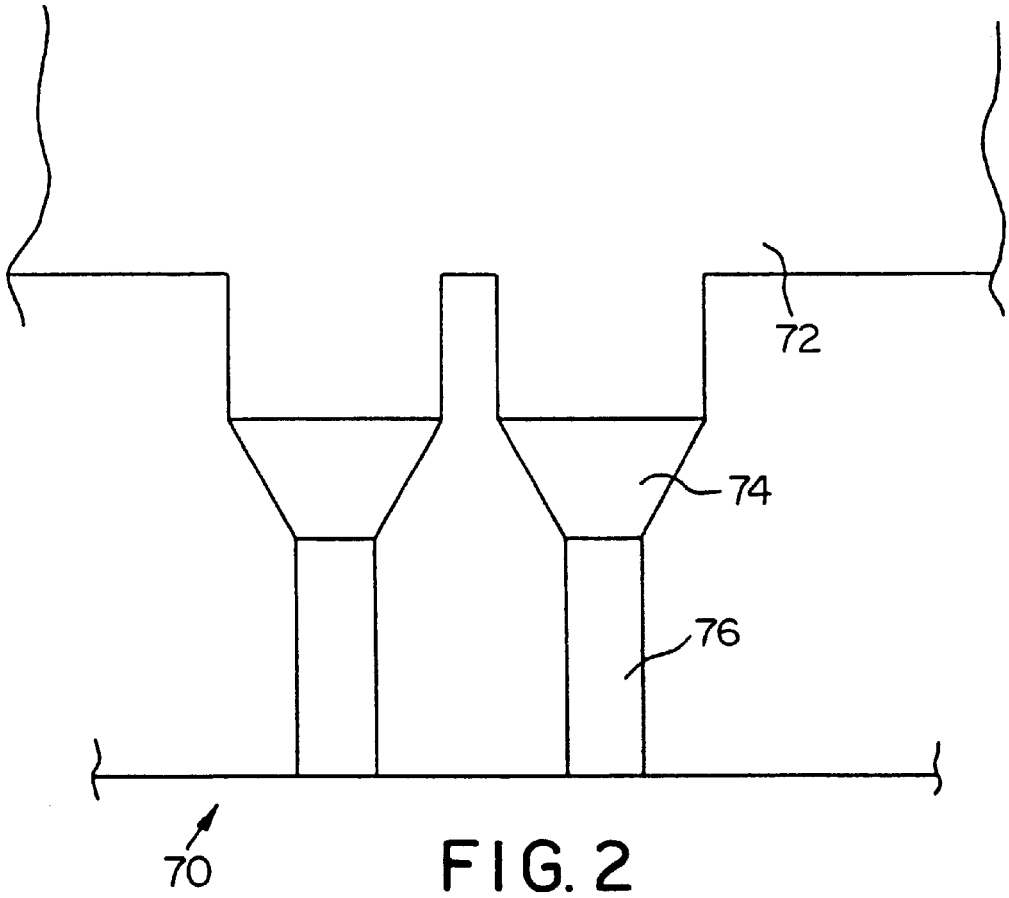
FIG. 2 is a schematic representation of a cross sectional view of the exemplary fiber forming dual capillaries of the present invention and surrounding elements of a meltspun die.

As shown in FIG. 2, die tip 70 defines a polymer supply passage 72 that terminates in further passages defined by counterbores 74 which are connected to capillaries 76. While schematic in nature, it will be appreciated that FIG. 2 shows dual capillaries 76 which are individual passages formed in the die tip 70. The differential capillary shapes are more clearly seen in FIG. 3. Generally, it is preferred that the capillaries of the present invention have a length to width ratio of between about 4:1 to about 12:1; and more preferably between about 6:1 to about 10:1, with length being defined in the direction of polymer flow and width being the capillary diameter.

According to the present invention, each fiber is produced by the two capillaries of a dual capillary design. FIGS. 3–6 detail exemplary embodiments of these dual capillary designs according to the present invention. It is believed that use of differently shaped capillaries to produce a single fiber causes the one side of the fiber with increased shear to have a lower viscosity and lower melt strength with subsequently higher orientation within that segment of the fiber. Differential polymer structure between the two capillaries is further believed to result in differential cooling rates between fiber segments, further helping to produce crimp.

Figure 3:
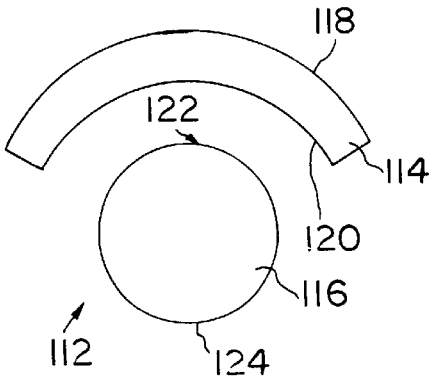
FIG. 3 is a first exemplary dual capillary design for producing crimped homofilament fibers according to the present invention.

As seen in FIG. 3, the dual capillary design 112 has a first capillary 114 and a second capillary 116. The first capillary 114 has an outside border 118 and an inside border 120 located adjacent the second capillary 116 at a distance sufficiently close to cause polymer extrudate from the first and second capillaries to meld or conjoin into a single fiber. The outside border 118 is arcuate and extends over about 120°. The inside border 120 is also arcuate and extends over about 120° but has a smaller radius than the outside border. The second capillary 116 is shown as substantially circular such that its inside border 122, facing and adjacent the first capillary 114, is arcuate. The second capillary distal border 124, that is distal from the first capillary, is of course also arcuate. The second capillary while shown as circular may be substantially elliptical if desired.

Figure 4:
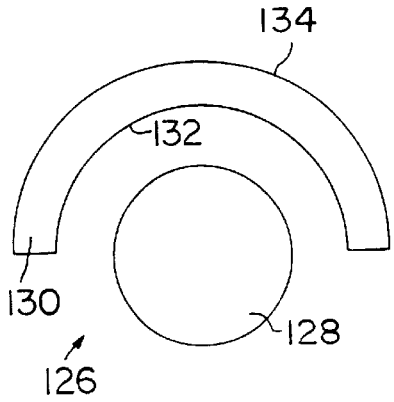
FIG. 4 is a second exemplary dual capillary design for producing crimped homofilament fibers according to the present invention.

Referencing FIG. 4, a dual capillary design 126 similar to FIG. 3 has a circular second capillary 128 like the design of FIG. 3. The first capillary 130, like FIG. 3, also has arcuate inside and outside borders 132 and 134, respectively, but the arcs extend over about 180°.

Figure 5:
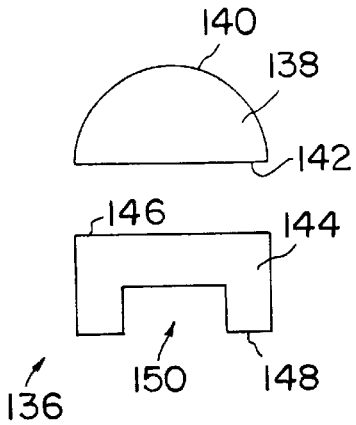
FIG. 5 is a third exemplary dual capillary design for producing crimped homofilament fibers according to the present invention.

Referencing FIG. 5, the dual capillary design 136 has a substantially half round first capillary 138 with an arcuate outside border 140 and a flat inside border 142 adjacent the second capillary 144. The second capillary has a flat inside border 146 adjacent the first capillary inside border 142 and of substantially the same length. The overall shape of the second capillary 144 is that of a squared-off arch, with the distal border 148 of the second capillary 144 containing a squared-off "U" shape 150 with the bight of the "U" extending towards the second capillary inside border 146.

Figure 6:
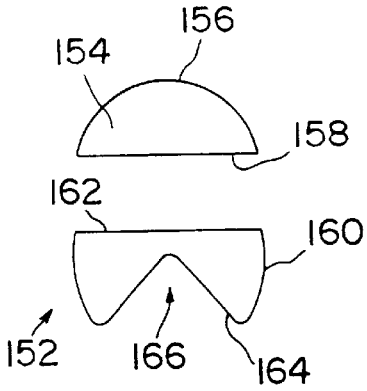
FIG. 6 is a fourth exemplary dual capillary design for producing crimped homofilament fibers according to the present invention.

Referencing FIG. 6, a dual capillary design 152 similar to FIG. 5 has a first capillary 154 with a smaller chorded section of a circular area than the half round first capillary of FIG. 5. The first capillary outside border 156 is again arcuate while the inside border 158 is flat. The overall shape of the second capillary 160 is again substantially arch-shaped with its inside border 162 being flat and slightly longer than or coextensive with the inside border 158 of the first capillary 154. The distal border 164 of the second capillary forms a "V"-shaped arch 166 of about 90° with the point of the arch extending towards the second capillary inside border 162.

Further, during processing of the extrudate, quick application of the quenching fluid to both sides of the fiber is believed to best help fix the stress differentials induced by the dual capillaries and aid in overall crimping. Quenching fluid may alternatively be directed towards a particular orientation of the dual capillary design in order to affect crimping. It was generally found that quenching directed toward the more highly shaped capillary side resulted in smaller crimps.

Having thus described means and method for producing homofilament crimped thermoplastic fibers through the use of dual capillaries, it will be appreciated that while this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A process for making crimped fibers, comprising the steps of:

extruding a liquid polymer from a first capillary having a first capillary inside border and a first capillary outside border, the first capillary outside border being curved;

extruding the liquid polymer from a second capillary having a second capillary inside border proximal to the first capillary inside border and a second capillary outside border distal from the first capillary inside border, the first capillary inside border and the second capillary inside border being parallel in a direction transverse to a flow of the liquid polymer; and forming a single filament from concurrent liquid polymer extrusions from the first and second capillaries, the filament having conjoined sections from each of the first capillary and the second capillary; each conjoined section having a different induced shear thereby causing the filament to crimp.

2. The process for making crimped fibers of claim 1, wherein the liquid polymer is polypropylene.

3. The process for making crimped fibers according to claim 1, further comprising the step of directing quenching fluid at both sides of the filament.

4. The process for making crimped fibers according to claim 1, further comprising the step of: drawing the filament while in its plastic state to produce a filament with a substantially round cross section.

5. The process for making crimped fibers according to claim 3, further comprising the step of: drawing the filament while in its plastic state to produce a filament with a substantially round cross section.

6. The process according to claim 1, further including the step of supplying the second capillary in a shape with both inside and outside borders being substantially arcuate.

7. The process according to claim 1, further including the step of supplying the first capillary in a shape that is substantially circular or substantially elliptical.

8. The process according to claim 6, further including the step of supplying the first capillary in a shape that is substantially circular or substantially elliptical.

9. The process according to claim 1, further including the step of supplying the first capillary in a shape that provides a substantially arcuate outside border and a flat inside border.

10. The process according to claim 1, further including the step of supplying the second capillary in a shape that is substantially arch-shaped.

11. The process according to claim 9, further including the step of supplying the second capillary in a shape that is substantially arch-shaped.

12. The process according to claim 2, further including the step of supplying the second capillary in a shape with both inside and outside borders being substantially arcuate.

13. The process according to claim 2, further including the step of supplying the first capillary in a shape that is substantially circular or substantially elliptical.

14. The process according to claim 12, further including the step of supplying the first capillary in a shape that is substantially circular or substantially elliptical.

15. The process according to claim 2, further including the step of supplying the first capillary in a shape that provides a substantially arcuate outside border and a flat inside border.

16. The process according to claim 2, further including the step of supplying the second capillary in a shape that is substantially arch-shaped.

17. The process according to claim 15, further including the step of supplying the second capillary in a shape that is substantially arch-shaped.

18. The process according to claim 3, further including the step of supplying the second capillary in a shape with both inside and outside borders being substantially arcuate.

19. The process according to claim 3, further including the step of supplying the first capillary in a shape that is substantially circular or substantially elliptical.

20. The process according to claim 18, further including the step of supplying the first capillary in a shape that is substantially circular or substantially elliptical.

21. The process according to claim 3, further including the step of supplying the first capillary in a shape that provides a substantially arcuate outside border and a flat inside border.

22. The process according to claim 3, further including the step of supplying the second capillary in a shape that is substantially arch-shaped.

23. The process according to claim 21, further including the step of supplying the second capillary in a shape that is substantially arch-shaped.

24. The process according to claim 4, further including the step of supplying the second capillary in a shape with both inside and outside borders being substantially arcuate.

25. The process according to claim 4, further including the step of supplying the first capillary in a shape that is substantially circular or substantially elliptical.

26. The process according to claim 24, further including the step of supplying the first capillary in a shape that is substantially circular or substantially elliptical.

27. The process according to claim 4, further including the step of supplying the first capillary in a shape that provides a substantially arcuate outside border and a flat inside border.

28. The process according to claim 4, further including the step of supplying the second capillary in a shape that is substantially arch-shaped.

29. The process according to claim 27, further including the step of supplying the second capillary in a shape that is substantially arch-shaped.

30. The process for making crimped fibers according to claim 1, further comprising the step of producing a plurality of single filaments and collecting the plurality of the single filaments into a nonwoven web.

31. The process for making crimped fibers according to claim 2, further comprising the step of producing a plurality of single filaments and collecting the plurality of the single filaments into a nonwoven web.

32. The process for making crimped fibers according to claim 3, further comprising the step of producing a plurality of single filaments and collecting the plurality of the single filaments into a nonwoven web.

33. The process for making crimped fibers according to claim 4, further comprising the step of producing a plurality of single filaments and collecting the plurality of the single filaments into a nonwoven web.

* * * * *